US011037506B2

(12) United States Patent
Noh et al.

(10) Patent No.: US 11,037,506 B2
(45) Date of Patent: Jun. 15, 2021

(54) ORGANIC LIGHT EMITTING DIODE DISPLAY DEVICE SUPPORTING VARIABLE FRAME MODE, AND METHOD OF OPERATING ORGANIC LIGHT EMITTING DIODE DISPLAY DEVICE

(71) Applicant: Samsung Display Co., Ltd., Yongin-si (KR)

(72) Inventors: Jin Woo Noh, Hwaseong-si (KR); Yun Ki Bae, Incheon (KR); Kwang Suk Shin, Anyang-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 16/715,581

(22) Filed: Dec. 16, 2019

(65) Prior Publication Data

US 2020/0193915 A1 Jun. 18, 2020

(30) Foreign Application Priority Data

Dec. 18, 2018 (KR) ..... 10-2018-0163744

(51) Int. Cl.

| | |
|---|---|
| ***G09G 3/3275*** | (2016.01) |
| ***G09G 3/3266*** | (2016.01) |
| ***G09G 3/3233*** | (2016.01) |
| ***G09G 3/3225*** | (2016.01) |

(52) U.S. Cl.

CPC ..... *G09G 3/3275* (2013.01); *G09G 3/3266* (2013.01); *G09G 2320/0247* (2013.01)

(58) Field of Classification Search

USPC ..... 345/691

See application file for complete search history.

(56) References Cited

U.S. PATENT DOCUMENTS

| | | | | |
|---|---|---|---|---|
| 2003/0030655 | A1* | 2/2003 | Ooe | G09G 3/2944 345/690 |
| 2005/0243077 | A1* | 11/2005 | Chung | G09G 3/3258 345/204 |
| 2006/0061529 | A1* | 3/2006 | Kim | G09G 3/3266 345/87 |
| 2008/0246701 | A1* | 10/2008 | Park | G09G 3/3233 345/77 |
| 2014/0347402 | A1* | 11/2014 | Kaplan | G09G 3/3258 345/690 |

(Continued)

FOREIGN PATENT DOCUMENTS

| | | |
|---|---|---|
| KR | 10-2016-0082877 | 7/2016 |
| KR | 10-2018-0076490 | 7/2018 |

*Primary Examiner* — Chineyere D Wills-Burns

(74) *Attorney, Agent, or Firm* — H.C. Park & Associates, PLC

(57) ABSTRACT

An organic light emitting diode (OLED) display device supporting a variable frame mode includes an OLED display panel, a data driver configured to provide a data signal to the OLED display panel, a scan driver configured to provide a scan signal to the OLED display panel, an emission driver configured to provide an emission control signal to the OLED display panel, and a controller configured to control the data driver, the scan driver and the emission driver, to count a time of a current frame, and to control the emission driver to decrease an off period ratio of the emission control signal as the counted time of the current frame increases.

19 Claims, 11 Drawing Sheets

(56) References Cited

U.S. PATENT DOCUMENTS

| | | | | |
|---|---|---|---|---|
| 2015/0097764 | A1* | 4/2015 | Pyo | G09G 3/3233 345/77 |
| 2015/0279274 | A1* | 10/2015 | Pyo | G09G 3/3233 345/77 |
| 2015/0364076 | A1* | 12/2015 | Park | G09G 3/2081 345/77 |
| 2016/0189635 | A1 | 6/2016 | Lee et al. | |
| 2016/0307490 | A1* | 10/2016 | Lee | G09G 3/2022 |
| 2018/0102092 | A1* | 4/2018 | Kubota | G09G 3/3233 |
| 2018/0174516 | A1* | 6/2018 | Kim | H01L 27/3276 |
| 2018/0293944 | A1* | 10/2018 | Kim | G09G 3/3266 |
| 2020/0082781 | A1* | 3/2020 | An | G09G 3/20 |

* cited by examiner

ORGANIC LIGHT EMITTING DIODE DISPLAY DEVICE SUPPORTING VARIABLE FRAME MODE, AND METHOD OF OPERATING ORGANIC LIGHT EMITTING DIODE DISPLAY DEVICE

CROSS-REFERENCE TO RELATED APPLICATION

This application claims priority from and the benefit of Korean Patent Application No. 10-2018-0163744, filed on Dec. 18, 2018, which is hereby incorporated by reference for all purposes as if fully set forth herein.

BACKGROUND

Field

Exemplary embodiments of the invention relate generally to display devices, and more specifically to organic light emitting diode display devices supporting variable frame modes, and methods of operating the organic light emitting diode display devices.

Discussion of the Background

A display device, such as an organic light emitting diode (OLED) display device, may generally display an image with (or at) a constant frame rate of about 60 Hz or more. However, a frame rate of rendering by a host processor (e.g., a graphic processing unit (GPU) or a graphic card) providing frame data to the OLED display device may be different from the frame rate (refresh rate) of the OLED display device. In particular, when the host processor provides the OLED display device with frame data for a game image (gaming image) that requires complicated rendering, the frame rate mismatch may be intensified, and a tearing phenomenon may occur where a boundary line is caused by the frame rate mismatch in an image of the OLED display device.

To prevent or reduce the tearing phenomenon, a variable frame mode (e.g., variable refresh rate mode such as FreeSync, G-Sync, etc.) has been developed in which a host processor provides frame data to an OLED display device with a variable frame rate by changing a time of a blank period in each frame. An OLED display device supporting the variable frame mode may display an image in synchronization with the variable frame rate, thereby reducing or preventing the tearing phenomenon.

However, in the OLED display device operating in the variable frame mode, the time (or a duration of time) of the blank period may be increased compared with a time of a blank period in a normal mode in which an image is displayed with a constant frame rate, and the increased blank period may cause a leakage current, etc., which results in deterioration of luminance. Further, in the case where the luminance is deteriorated in a previous frame, a flicker may occur between the previous frame and a current frame.

The above information disclosed in this Background section is only for understanding of the background of the inventive concepts, and, therefore, it may contain information that does not constitute prior art.

SUMMARY

Devices constructed according to exemplary embodiments of the invention are capable of providing an organic light emitting diode (OLED) display device capable of improving an image quality in a variable frame mode.

Methods according to exemplary implementations of the invention are capable of operating an OLED display device with improved image quality in a variable frame mode.

Additional features of the inventive concepts will be set forth in the description which follows, and in part will be apparent from the description, or may be learned by practice of the inventive concepts.

According to one or more exemplary embodiments, there is provided an organic light emitting diode (OLED) display device supporting a variable frame mode. The OLED display device includes an OLED display panel, a data driver configured to provide a data signal to the OLED display panel, a scan driver configured to provide a scan signal to the OLED display panel, an emission driver configured to provide an emission control signal to the OLED display panel, and a controller configured to control the data driver, the scan driver and the emission driver, to count a time of a current frame, and to control the emission driver to decrease an off period ratio of the emission control signal as the counted time of the current frame increases.

The controller may control the emission driver to gradually or stepwise decrease the off period ratio of the emission control signal as the counted time of the current frame increases to compensate for luminance of the OLED display panel which is decreased as the counted time of the current frame increases.

The controller may be configured to determine an initial off period ratio of the emission control signal in response to a dimming control signal, to control the emission driver to output the emission control signal having the initial off period ratio until the counted time of the current frame reaches a time of a minimum frame corresponding to a maximum frame rate of the variable frame mode, and to control the emission driver to output the emission control signal having the off period ratio that is decreased from the initial off period ratio when the counted time of the current frame reaches the time of the minimum frame.

The controller may be configured to determine a length of a whole off period of the emission control signal in the minimum frame in response to the dimming control signal, to determine a number of cycles of the emission control signal and an initial length of an off period in one cycle of the emission control signal during the minimum frame based on the determined length of the whole off period, and to decrease a length of the off period in one cycle of the emission control signal from the initial length when the counted time of the current frame reaches the time of the minimum frame.

The OLED display device may, further include a memory device configured to store reference time information for a plurality of reference times that are to be compared with the counted time of the current frame, and off period offset information for a plurality of off period offsets respectively corresponding to the plurality of reference times.

The controller may be configured to compare the counted time of the current frame with the plurality of reference times based on the reference time information, and, when the counted time of the current frame reaches one reference time of the plurality of reference times, to decrease a length of an off period in one cycle of the emission control signal by one off period offset corresponding to the one reference time among the plurality of off period offsets based on the off period offset information.

The controller may be configured to control the emission driver to output the emission control signal where a first off period and a first on period are repeated with a first period until the counted time of the current frame reaches a time of a minimum frame corresponding to a maximum frame rate of the variable frame mode, and to control the emission driver to output the emission control signal where a second off period and a second on period are repeated with a second period shorter than the first period when the counted time of the current frame reaches the time of the minimum frame.

A ratio of the second off period to the second on period may be decreased compared with a ratio of the first off period to the first on period.

According to one or more exemplary embodiments, there is provided a method of operating an organic light emitting diode (OLED) display device supporting a variable frame mode. In the method, an initial off period ratio of an emission control signal is determined in response to a dimming control signal, a time of a current frame is counted, an OLED display panel of the OLED display device is driven based on the emission control signal having the initial off period ratio until the counted time of the current frame reaches a first reference time, an off period ratio of the emission control signal is decreased from the initial off period ratio when the counted time of the current frame reaches the first reference time, and the OLED display panel is driven based on the emission control signal having the decreased off period ratio when the counted time of the current frame reaches the first reference time.

To determine the initial off period ratio of the emission control signal in response to the dimming control signal, a length of a whole off period of the emission control signal in a minimum frame corresponding to a maximum frame rate of the variable frame mode may be determined in response to the dimming control signal, and a number of cycles of the emission control signal and an initial length of an off period in one cycle of the emission control signal during the minimum frame may be determined based on the determined length of the whole off period.

To decrease the off period ratio of the emission control signal from the initial off period ratio, a length of the off period in one cycle of the emission control signal may be decreased from the initial length.

The first reference time may correspond to a time of a minimum frame corresponding to a maximum frame rate of the variable frame mode.

The counted time of the current frame may be compared with a second reference time longer than the first reference time, and the decreased off period ratio of the emission control signal may be further decreased when the counted time of the current frame reaches the second reference time.

In exemplary embodiments, reference time information for a plurality of reference times including the first reference time, and off period offset information for a plurality of off period offsets respectively corresponding to the plurality of reference times may be stored, the counted time of the current frame may be compared with the plurality of reference times based on the reference time information, and, when the counted time of the current frame reaches one reference time of the plurality of reference times, a length of an off period in one cycle of the emission control signal may be decreased by one off period offset corresponding to the one reference time among the plurality of off period offsets based on the off period offset information.

According to one or more exemplary embodiments, there is provided a method of operating an organic light emitting diode (OLED) display device supporting a variable frame mode. In the method, a time of a current frame is counted, an OLED display panel of the OLED display device is driven based on an emission control signal where a first off period and a first on period are repeated with a first period until the counted time of the current frame reaches a first reference time, and the OLED display panel of the OLED display device is driven based on the emission control signal where a second off period and a second on period are repeated with a second period shorter than the first period when the counted time of the current frame reaches the first reference time.

The first reference time may correspond to a time of a minimum frame corresponding to a maximum frame rate of the variable frame mode.

A ratio of the second off period to the second on period may be a same as a ratio of the first off period to the first on period.

Period information for the second period may be stored in a memory device included in the OLED display device.

A ratio of the second off period to the second on period may be decreased compared with a ratio of the first off period to the first on period.

Reference time information for a plurality of reference times including the first reference time, and off period offset information for a plurality of off period offsets respectively corresponding to the plurality of reference times may be stored, the counted time of the current frame may be compared with the plurality of reference times based on the reference time information, and, when the counted time of the current frame reaches one reference time of the plurality of reference times, a length of the second off period in one cycle of the emission control signal may be decreased by one off period offset corresponding to the one reference time among the plurality of off period offsets based on the off period offset information.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the inventive concepts.

DETAILED DESCRIPTION

Figure 1:
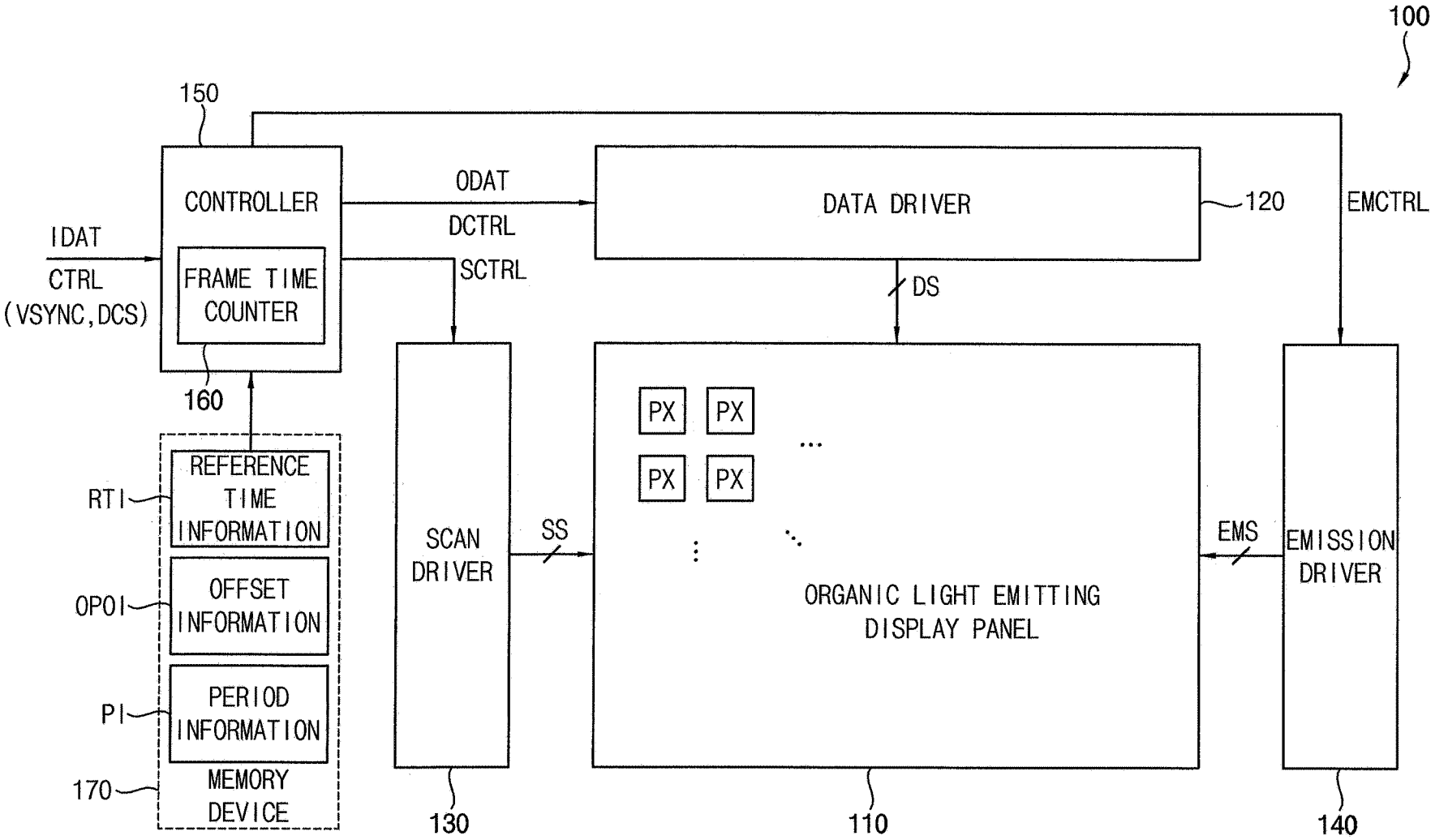
FIG. 1 is a block diagram illustrating an organic light emitting diode (OLED) display device according to exemplary embodiments.

In the following description, for the purposes of explanation, numerous specific details are set forth in order to provide a thorough understanding of various exemplary embodiments or implementations of the invention. As used herein "embodiments" and "implementations" are interchangeable words that are non-limiting examples of devices or methods employing one or more of the inventive concepts disclosed herein. It is apparent, however, that various exemplary embodiments may be practiced without these specific details or with one or more equivalent arrangements. In other instances, well-known structures and devices are shown in block diagram form in order to avoid unnecessarily obscuring various exemplary embodiments. Further, various exemplary embodiments may be different, but do not have to be exclusive. For example, specific shapes, configurations, and characteristics of an exemplary embodiment may be used or implemented in another exemplary embodiment without departing from the inventive concepts.

Unless otherwise specified, the illustrated exemplary embodiments are to be understood as providing exemplary features of varying detail of some ways in which the inventive concepts may be implemented in practice. Therefore, unless otherwise specified, the features, components, modules, layers, films, panels, regions, and/or aspects, etc. (hereinafter individually or collectively referred to as "elements"), of the various embodiments may be otherwise combined, separated, interchanged, and/or rearranged without departing from the inventive concepts.

In the accompanying drawings, the size and relative sizes of elements may be exaggerated for clarity and/or descriptive purposes. When an exemplary embodiment may be implemented differently, a specific process order may be performed differently from the described order. For example, two consecutively described processes may be performed substantially at the same time or performed in an order opposite to the described order. Also, like reference numerals denote like elements.

When an element is referred to as being "on," "connected to," or "coupled to" another element, it may be directly on, connected to, or coupled to the other element or intervening elements may be present. When, however, an element is referred to as being "directly on," "directly connected to," or "directly coupled to" another element, there are no intervening elements present. To this end, the term "connected" may refer to physical, electrical, and/or fluid connection, with or without intervening elements. Further, the D1-axis, the D2-axis, and the D3-axis are not limited to three axes of a rectangular coordinate system, such as the x, y, and z—axes, and may be interpreted in a broader sense. For example, the D1-axis, the D2-axis, and the D3-axis may be perpendicular to one another, or may represent different directions that are not perpendicular to one another. For the purposes of this disclosure, "at least one of X, Y, and Z" and "at least one selected from the group consisting of X, Y, and Z" may be construed as X only, Y only, Z only, or any combination of two or more of X, Y, and Z, such as, for instance, XYZ, XYY, YZ, and ZZ. As used herein, the term "and/or" includes any and all combinations of one or more of the associated listed items.

Although the terms "first," "second," etc. may be used herein to describe various types of elements, these elements should not be limited by these terms. These terms are used to distinguish one element from another element. Thus, a first element discussed below could be termed a second element without departing from the teachings of the disclosure.

Spatially relative terms, such as "beneath," "below," "under," "lower," "above," "upper," "over," "higher," "side" (e.g., as in "sidewall"), and the like, may be used herein for descriptive purposes, and, thereby, to describe one elements relationship to another element(s) as illustrated in the drawings. Spatially relative terms are intended to encompass different orientations of an apparatus in use, operation, and/or manufacture in addition to the orientation depicted in the drawings. For example, if the apparatus in the drawings is turned over, elements described as "below" or "beneath" other elements or features would then be oriented "above" the other elements or features. Thus, the exemplary term "below" can encompass both an orientation of above and below. Furthermore, the apparatus may be otherwise oriented (e.g., rotated 90 degrees or at other orientations), and, as such, the spatially relative descriptors used herein interpreted accordingly.

The terminology used herein is for the purpose of describing particular embodiments and is not intended to be limiting. As used herein, the singular forms, "a," "an," and "the" are intended to include the plural forms as well, unless the context clearly indicates otherwise. Moreover, the terms "comprises," "comprising," "includes," and/or "including," when used in this specification, specify the presence of stated features, integers, steps, operations, elements, components, and/or groups thereof, but do not preclude the presence or addition of one or more other features, integers, steps, operations, elements, components, and/or groups thereof. It is also noted that, as used herein, the terms "substantially," "about," and other similar terms, are used as terms of approximation and not as terms of degree, and, as such, are utilized to account for inherent deviations in measured, calculated, and/or provided values that would be recognized by one of ordinary skill in the art.

As is customary in the field, some exemplary embodiments are described and illustrated in the accompanying drawings in terms of functional blocks, units, and/or modules. Those skilled in the art will appreciate that these blocks, units, and/or modules are physically implemented by electronic (or optical) circuits, such as logic circuits, discrete components, microprocessors, hard-wired circuits, memory elements, wiring connections, and the like, which may be formed using semiconductor-based fabrication techniques or other manufacturing technologies. In the case of the blocks, units, and/or modules being implemented by microprocessors or other similar hardware, they may be programmed and controlled using software (e.g., microcode) to perform various functions discussed herein and may optionally be driven by firmware and/or software. It is also contemplated that each block, unit, and/or module may be implemented by dedicated hardware, or as a combination of dedicated hardware to perform some functions and a processor (e.g., one or more programmed microprocessors and associated circuitry) to perform other functions. Also, each block, unit, and/or module of some exemplary embodiments may be physically separated into two or more interacting and discrete blocks, units, and/or modules without departing from the scope of the inventive concepts. Further, the blocks, units, and/or modules of some exemplary embodiments may be physically combined into more complex blocks, units, and/or modules without departing from the scope of the inventive concepts.

Unless otherwise defined, all terms (including technical and scientific terms) used herein have the same meaning as commonly understood by one of ordinary skill in the art to which this disclosure is a part. Terms, such as those defined in commonly used dictionaries, should be interpreted as having a meaning that is consistent with their meaning in the context of the relevant art and should not be interpreted in an idealized or overly formal sense, unless expressly so defined herein.

Figure 2:
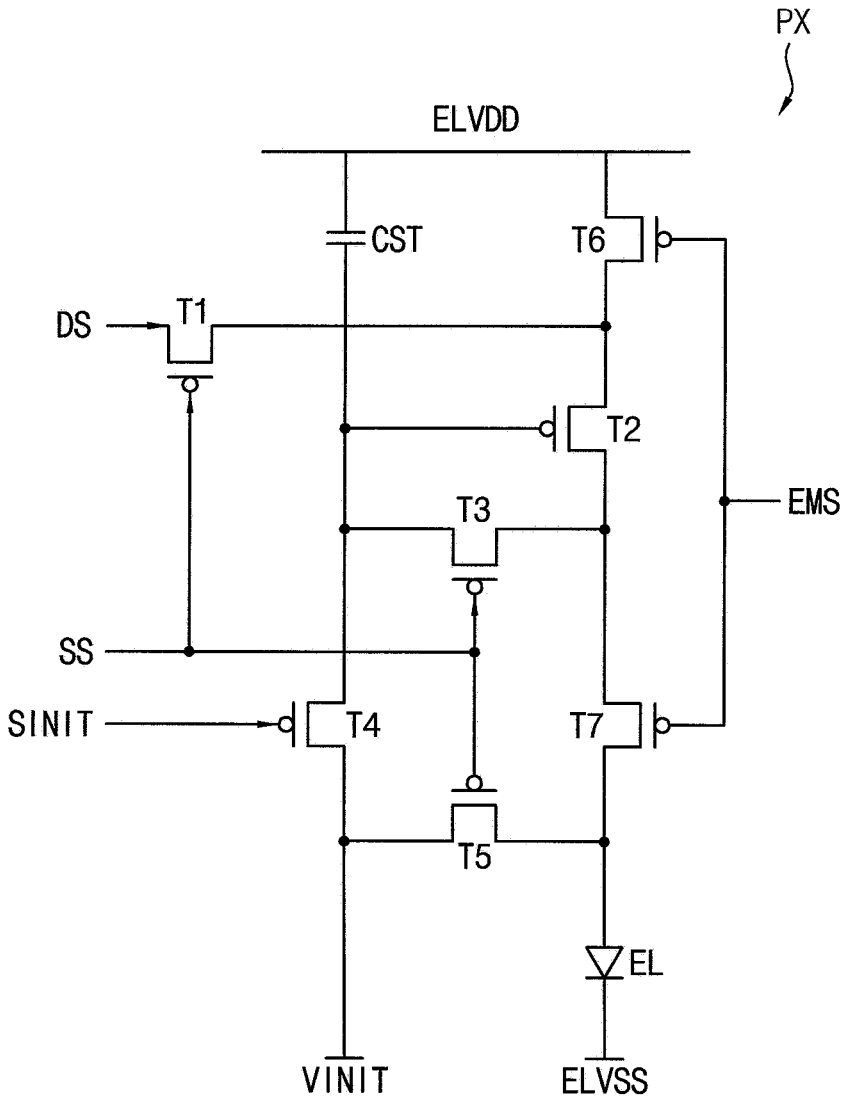
FIG. 2 is a circuit diagram illustrating an example of a pixel included in an OLED display device of FIG. 1.
Figure 3:
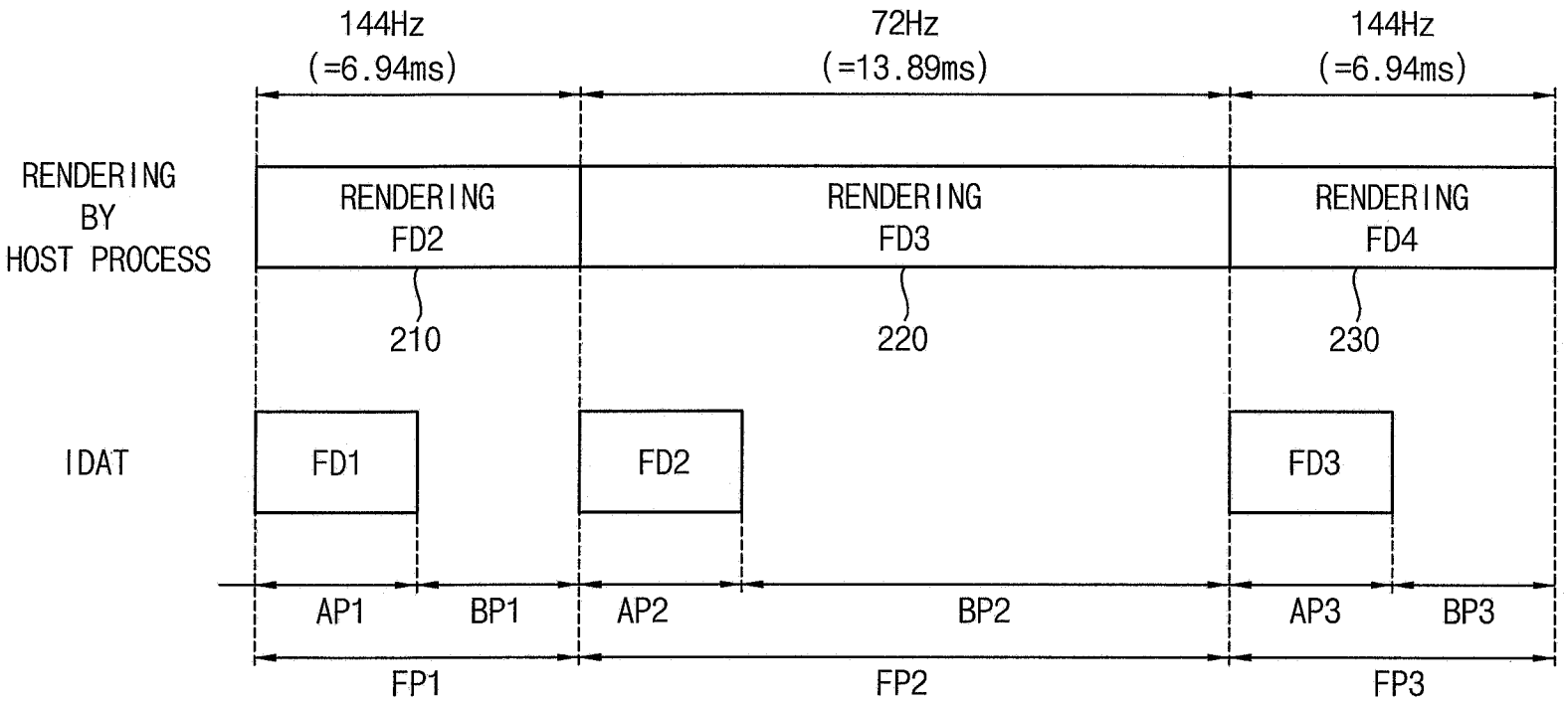
FIG. 3 is a timing diagram illustrating an example of input image data input to an OLED display device of FIG. 1 in a variable frame mode.
Figure 4:
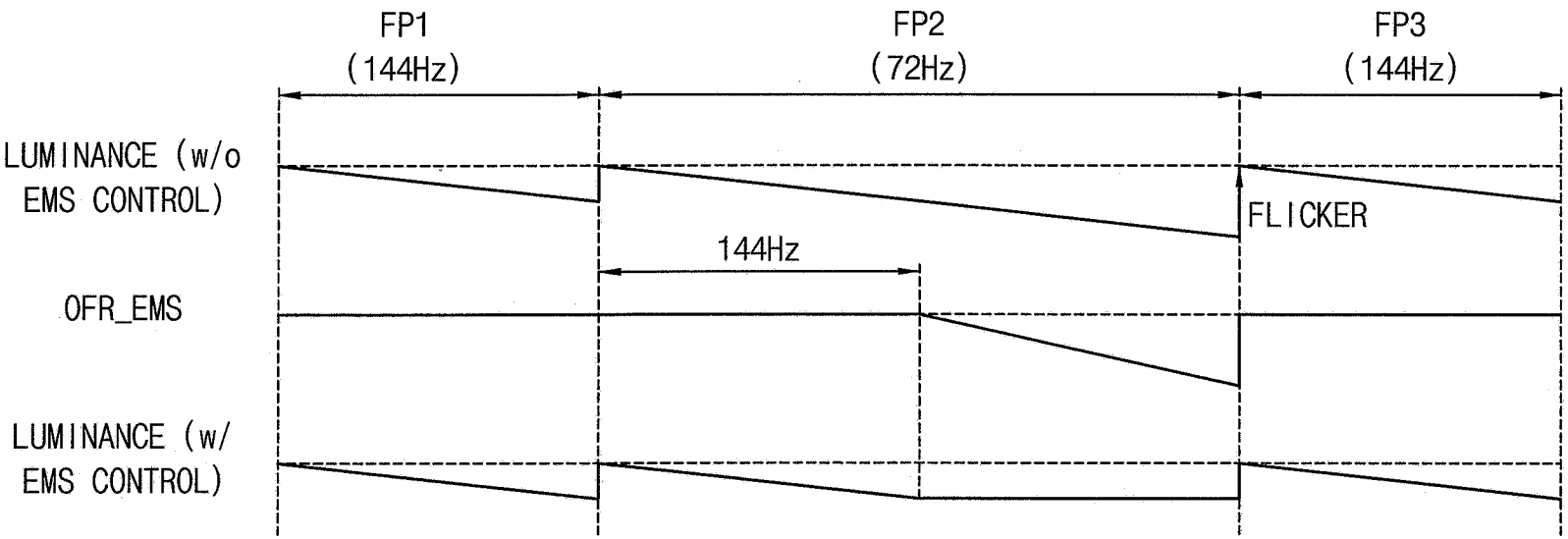
FIG. 4 is a timing diagram for describing an operation of an OLED display device of FIG. 1.

FIG. 1 is a block diagram illustrating an organic light emitting diode (OLED) display device according to exemplary embodiments, FIG. 2 is a circuit diagram illustrating an example of a pixel included in an OLED display device of FIG. 1, FIG. 3 is a timing diagram illustrating an example of input image data input to an OLED display device of FIG. 1 in a variable frame mode, and FIG. 4 is a timing diagram for describing an operation of an OLED display device of FIG. 1.

Referring to FIG. 1, an OLED display device 100 according to exemplary embodiments may include an OLED display panel 110, a data driver 120 that provides a data signal DS to the OLED display panel 110, a scan driver 130 that provides a scan signal SS to the OLED display panel 110, an emission driver 140 that provides an emission control signal EMS to the OLED display panel 110, and a controller 150 that controls the data driver 120, the scan driver 130 and the emission driver 140.

The display panel 110 may include a plurality of data lines, a plurality of scan lines, a plurality of emission control lines, and a plurality of pixels PX coupled to the plurality of data lines, the plurality of scan lines and the plurality of emission control lines. Each pixel PX may selectively emit light in response to the emission control signal EMS.

In some exemplary embodiments, as illustrated in FIG. 2, each pixel PX may have a 7T1C structure including seven transistors T1, T2, T3, T4, T5, T6, and T7 and one capacitor CST. For example, each pixel PX may include a first transistor T1 that transfers the data signal DS to one terminal of a second transistor T2 in response to the scan signal SS, a storage capacitor CST that stores the data signal transferred through a diode-connected second transistor T2, the second transistor T2 that generates a driving current based on a voltage stored in the storage capacitor CST, a third transistor T3 that diode-connects the second transistor T2 in response to the scan signal SS, a fourth transistor T4 that applies an initialization voltage VINIT to the storage capacitor CST and a gate of the second transistor T2 in response to an initialization signal SINIT, a fifth transistor T5 that applies the initialization voltage VINIT to an organic light emitting diode EL in response to the scan signal SS, a sixth transistor T6 that connects a line of a first power supply voltage ELVDD to the second transistor T2 in response to the emission control signal EMS, a seventh transistor T7 that connects the second transistor T2 to the organic light emitting diode EL in response to the emission control signal EMS, and the organic light emitting diode EL coupled between the seventh transistor T7 and a line of a second power supply voltage ELVSS. However, the pixel PX according to exemplary embodiments may not be limited to an example of a pixel configuration illustrated in FIG. 2.

The data driver 120 may provide the data signal DS to the plurality of pixels PX through the plurality of data lines based on output image data ODAT and a data control signal DCTRL received from the controller 150. In some exemplary embodiments, the data control signal DCTRL may include, but not be limited to, an output data enable signal, a horizontal start signal and a load signal.

The scan driver 130 may provide the scan signal SS to the plurality of pixels PX through the plurality of scan lines based on a scan control signal SCTRL received from the controller 150. In some exemplary embodiments, the scan driver 130 may sequentially provide the scan signal SS to the plurality of pixels PX on a row-by-row basis. In some exemplary embodiments, the scan control signal SCTRL may include, but not be limited to, a scan start signal and a scan clock signal.

The emission driver 140 may provide the emission control signal EMS to the plurality of pixels PX through the plurality of emission control lines based on an emission driver control signal EMCTRL received from the controller 150. In some exemplary embodiments, the emission driver 140 may sequentially provide the emission control signal EMS to the plurality of pixels PX on a row-by-row basis such that the plurality of pixels PX may sequentially emit light on a row-by-row basis. In other exemplary embodiments, the emission driver 140 may substantially simultaneously provide the emission control signal EMS to the plurality of pixels PX such that the plurality of pixels PX may substantially simultaneously emit light.

The controller (e.g., a timing controller) 150 may receive input image data IDAT and a control signal CTRL from an external host processor (e.g., a graphic processing unit (GPU) or a graphic card). In some exemplary embodiments, the input image data IDAT may be RGB data including red image data, green image data and blue image data. In some exemplary embodiments, the control signal CTRL may include, but not be limited to, a vertical synchronization signal VSYNC, a horizontal synchronization signal, an input data enable signal, a master clock signal, etc. Further, in some exemplary embodiments, the control signal CTRL may further include a dimming control signal DCS representing a dimming level (or a luminance level) of the OLED display device 100. For example, the host processor may determine the dimming level (or the luminance level) of the OLED display device 100 based on a user's selection, luminance of external light, a remaining charge of a battery, etc., and may provide the determined dimming level (or the determined luminance level) to the controller 150. The controller 150 may generate the data control signal DCTRL, the scan control signal SCTRL, the emission driver control signal EMCTRL and the output image data ODAT based on the control signal CTRL and the input image data IDAT. The controller 150 may control an operation of the data driver 120 by providing the data control signal DCTRL and the output image data ODAT to the data driver 120, may control an operation of the scan driver 130 by providing the scan control signal SCTRL to the scan driver 130, and may control an operation of the emission driver 140 by providing the emission driver control signal EMCTRL to the emission driver 140.

The controller 150 according to exemplary embodiments may support a variable frame mode in which the host processor provides the input image data IDAT to the OLED display device 100 with a variable frame rate by changing a time (or a duration of time) of a blank period in each frame and the controller 150 provides the output image data ODAT to the data driver 120 in synchronization with the variable frame rate such that an image is displayed with the variable frame rate. For example, the variable frame mode may include a Free-Sync mode, a G-Sync mode, etc.

For example, as illustrated in FIG. 3, a period of each of renderings 210, 220, and 230 by the host processor (e.g., the GPU or the graphic card) may not be constant (in particular, in a case where game image data are rendered), and the host processor may provide the input image data IDAT, or frame data FD1, FD2 and FD3 to the OLED display device 100 in synchronization with, respectively, these irregular periods of renderings 210, 220, and230 in the variable frame mode. Thus, in the variable frame mode, each frame FP1, FP2 and FP3 may include a constant active period AP1, AP2 and AP3 having a constant time, and the host processor may provide the frame data FD1, FD2 and FD3 to the OLED display device 100 with a variable frame rate by changing a time of a blank period BP1, BP2 and BP3 of the frame FP1, FP2 and FP3.

In an example of FIG. 3, if a rendering 210 for second frame data FD2 is performed with a frequency of about 144 Hz in first frame FP1, the host processor may provide first frame data FD1 to the OLED display device 100 with a frame rate of about 144 Hz in the first frame FP1. Further, the host processor may output the second frame data FD2 during an active period AP2 of a second frame FP2, may continue a blank period BP2 of the second frame FP2 until rendering 220 for third frame data FD3 is completed. Thus, in the second frame FP2, if the rendering 220 for the third frame data FD3 is performed with a frequency of about 72 Hz, the host processor may provide the second frame data FD2 to the OLED display device 100 with a frame rate of about 72 Hz by increasing a time of the blank period BP2 of the second frame FP2. In third frame FP3, if a rendering 230 for fourth frame data FD4 is performed again with a frequency of about 144 Hz, the host processor may provide the third frame data FD3 to the OLED display device 100 again with a frame rate of about 144 Hz.

As described above, in the variable frame mode, each frame FP1, FP2 and FP3 may include a constant active period AP1, AP2 and AP3 having a constant time regardless of a variable frame rate, and a variable blank period BP1, BP2 and BP3 having a variable time corresponding to the variable frame rate. For example, in the variable frame mode, the time of the blank period BP1, BP2 and BP3 may increase as the frame rate decreases. In the variable frame mode, the controller 150 may receive the input image data DAT with the variable frame rate, and may output the output image data ODAT to the data driver 120 with the variable frame rate. Accordingly, the OLED display device 100 supporting the variable frame mode may display an image in synchronization with the variable frame rate, thereby reducing or preventing a tearing phenomenon caused by a frame rate mismatch.

In the variable frame mode, since a time of the blank period may be changed in each frame period, the time of the blank period may be increased compared with a length of a blank period in a normal mode where an image is displayed with a constant frame rate, and the increased blank period may cause a leakage current, etc., which results in deterioration of luminance and deterioration of an image quality. Further, in the case where the luminance is deteriorated in a previous frame, a flicker may occur between the previous frame and a current frame. To reduce or prevent the image quality deterioration and the occurrence of the flicker caused by the leakage current in the variable blank period, the controller 150 according to exemplary embodiments may count a time of a current frame, and may control the emission driver 140 to decrease an off period ratio (or to increase an on period ratio) of the emission control signal EMS as the counted time of the current frame increases. In some exemplary embodiments, the controller 150 may include a frame time counter 160 that counts the time of the current frame. Here, the off period ratio of the emission control signal EMS may be a ratio of an off period to a sum of the on period and the off period of the emission control signal EMS, and may be referred to as an AMOLED off ratio (AOR). If the off period ratio of the emission control signal EMS is decreased (or the on period ratio of the emission control signal EMS is increased) as the counted time of the current frame increases, the luminance deterioration caused by the increase of the time of the variable blank period may be compensated, and the occurrence of the flicker may be prevented.

In some exemplary embodiments, the controller 150 may control the emission driver 140 to gradually or stepwise decrease the off period ratio of the emission control signal EMS as the counted time of the current frame increases to compensate for luminance of the OLED display panel 110 which is decreased as the counted time of the current frame increases.

For example, as illustrated in FIG. 4, in a case where a first frame FP1 corresponds to the maximum frame rate (e.g., about 144 Hz) of the variable frame mode, and a second frame FP2 corresponds to a frame rate (e.g., about 72 Hz) lower than the maximum frame rate, in a conventional OLED display device where the off period ratio of the emission control signal EMS is not controlled, a blank period of the second frame FP2 is increased, luminance deterioration may occur in the increased blank period, and a flicker may occur at a start time point of a third frame FP3. However, in the OLED display device 100 according to exemplary embodiments, an off period ratio OFR_EMS of the emission control signal EMS may be decreased as a time of a current frame, for example the second frame FP2 increases, and thus the luminance deterioration in the increased blank period may be compensated. For example, as illustrated in FIG. 4, in the OLED display device 100 according to exemplary embodiments, the off period ratio OFR_EMS of the emission control signal EMS may be gradually decreased from when the time of the current frame, for example the second frame FP2 reaches a time of the minimum frame corresponding to the maximum frame rate of the variable frame mode. Accordingly, the luminance deterioration in the increased blank period may be compensated, and the occurrence of the flicker may be prevented.

In some exemplary embodiments, the controller 150 may receive the dimming control signal DCS representing the dimming level (or the luminance level) of the OLED display device 100, and may determine an initial off period ratio of the emission control signal EMS in response to the dimming control signal DCS. In some exemplary embodiments, the controller 150 may determine a length of a whole off period of the emission control signal EMS in the minimum frame corresponding to the maximum frame rate (e.g., about 144 Hz) in response to the dimming control signal DCS, and determine the number of cycles (each including one off period and one on period) of the emission control signal EMS and an initial length of the off period in one cycle of the emission control signal EMS during the minimum frame based on the determined length of the whole off period of the minimum frame. For example, in a case where the length of the whole off period of the emission control signal EMS corresponding to the dimming level indicated by the dimming control signal DCS is about 40 horizontal times, or 40 H, to allow a length (or time) of the off period in one cycle not to exceed a predetermined time, the controller 150 may determine the number of cycles in the minimum frame as 4, and may determine the initial length of the off period in each cycle as 10 H. However, the number of cycles and the initial length of the off period in each cycle may not be limited thereto. The controller 150 may control the emission driver 140 to output the emission control signal EMS having the initial off period ratio until the counted time of the current frame reaches the time of the minimum frame corresponding to the maximum frame rate of the variable frame mode.

When the counted time of the current frame reaches the time of the minimum frame, the controller 150 may control the emission driver 140 to output the emission control signal EMS having the off period ratio that is decreased from the initial off period ratio. For example, when the counted time of the current frame reaches the time of the minimum frame, the controller 150 may decrease the length of the off period in each cycle of the emission control signal EMS from the initial length.

In some exemplary embodiments, the OLED display device 100 may further include a memory device 170 that stores reference time information RTI and off period offset information OPOI. For example, the memory device 170 may be, but not limited to, a nonvolatile memory device, such as a flash memory device, which retains stored data even if the nonvolatile memory device is not supplied with power. The reference time information RTI may represent a plurality of reference times that are to be compared with the counted time of the current frame, and the off period offset information OPOI may represent a plurality of off period offsets respectively corresponding to the plurality of reference times. In some exemplary embodiments, the controller 150 may compare the counted time of the current frame with the plurality of reference times based on the reference time information RTI. When the counted time of the current frame reaches one reference time of the plurality of reference times, the controller 150 may decrease the length of the off period in one cycle (or each cycle) of the emission control signal EMS by one off period offset corresponding to the one reference time among the plurality of off period offsets based on the off period offset information OPOI. In some exemplary embodiments, the plurality of reference times indicated by the reference time information RTI and the plurality of off period offsets indicated by the off period offset information OPOI may be set or updated.

In some exemplary embodiments, the controller 150 may control the emission driver 140 to output the emission control signal EMS where a first off period and a first on period are repeated with a first period until the counted time of the current frame reaches the time of the minimum frame corresponding to the maximum frame rate of the variable frame mode, and may control the emission driver 140 to output the emission control signal EMS where a second off period and a second on period are repeated with a second period shorter than the first period when the counted time of the current frame reaches the time of the minimum frame. Accordingly, a probability that an active period of the next frame starts in the middle of a cycle including the second off period and the second on period may be reduced. Further, in some exemplary embodiments, a ratio of the second off period to the second on period (or to a sum of the second on period and the second off period) may be decreased compared with a ratio of the first off period to the first on period (or to a sum of the first on period and the first off period). In this case, the luminance deterioration in the variable frame mode may be compensated, and the occurrence of the flicker may be prevented.

As described above, in the OLED display device 100 according to exemplary embodiments, the time of the current frame may be counted, and the off period ratio of the emission control signal EMS may be decreased as the counted time of the current frame increases. Accordingly, the luminance deterioration and the occurrence of the flicker caused by the increase of the time of the variable blank period in the variable frame mode may be prevented, and the image quality of the OLED display device 100 may be improved.

Figure 5:
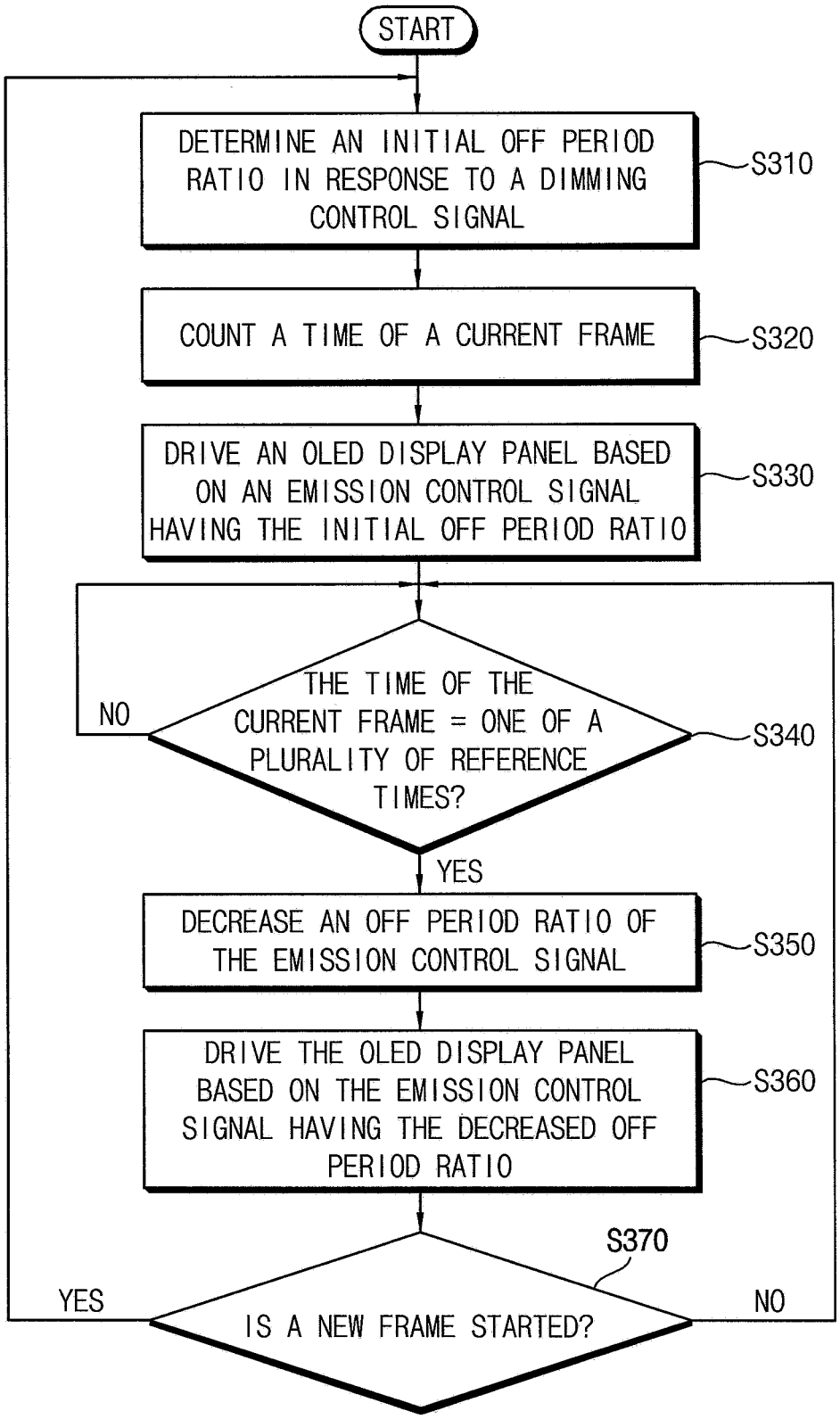
FIG. 5 is a flowchart illustrating a method of operating an OLED display device according to exemplary embodiments.
Figure 6:
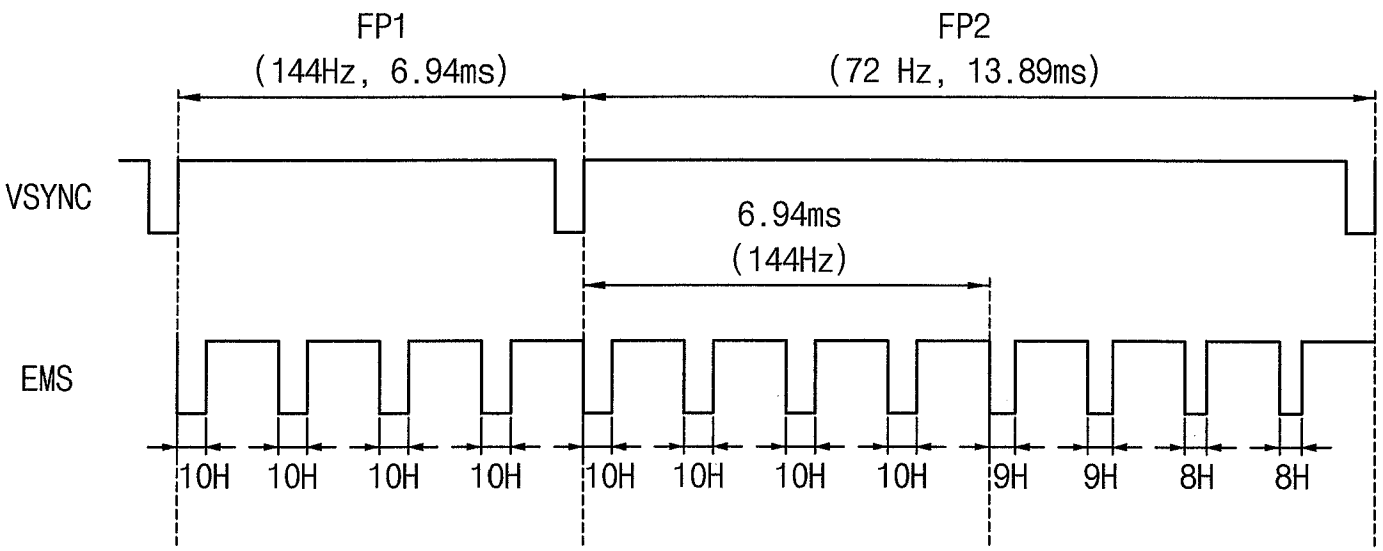
FIG. 6 is a timing diagram for an operation of an OLED display device performing a method of FIG. 5.

FIG. 5 is a flowchart illustrating a method of operating an OLED display device according to exemplary embodiments, and FIG. 6 is a timing diagram for an operation of an OLED display device performing a method of FIG. 5.

Referring to FIG. 1 and FIG. 5, in a method of operating an OLED display device 100 supporting a variable frame mode, an initial off period ratio of an emission control signal EMS may be determined in response to a dimming control signal DCS (S310). In some exemplary embodiments, the dimming control signal DCS may be generated by a host processor based on a user's selection, luminance of external light, a remaining charge of a battery, etc. In other exemplary embodiments, the dimming control signal DCS may be generated by a controller 150 of the OLED display device 100. In some exemplary embodiments, the controller 150 may determine a length (about 40 H in an example of FIG. 6) of a whole off period of the emission control signal EMS in a minimum frame corresponding to a maximum frame rate (e.g., about 144 Hz) of the variable frame mode based on a dimming level indicated by the dimming control signal DCS, and may determine the number of cycles (about four cycles in the example of FIG. 6) of the emission control signal EMS and an initial length (about 10 H in the example of FIG. 6) of an off period in one cycle (or each cycle) of the emission control signal EMS during the minimum frame based on the determined length of the whole off period.

A frame time counter 160 of the controller 150 may count a time of a current frame (S320), and, until the counted time of the current frame reaches a first reference time (S340: NO), the OLED display device 100 may drive an OLED display panel 110 based on the emission control signal EMS having the initial off period ratio (S330). In some exemplary embodiments, the first reference time may correspond to the time (e.g., about 6.94 ms) of the s minimum frame corresponding to the maximum frame rate (e.g., about 144 Hz) of the variable frame mode, and an emission driver 140 may provide the emission control signal EMS having the initial off period ratio to the OLED display panel 110 until the counted time of the current frame reaches the time (e.g., about 6.94 ms) of the minimum frame. For example, as illustrated in FIG. 6, during about 6.94 ms after each frame FP1 and FP2 is started, the emission driver 140 may provide the OLED display panel 110 with the emission control signal EMS having four cycles and the off period of about 10 H in each cycle.

When the counted time of the current frame reaches the first reference time (S340: YES), the controller 150 may control the emission driver 140 to decrease an off period ratio of the emission control signal EMS from the initial off period ratio (S350). In some exemplary embodiments, to decrease the off period ratio of the emission control signal EMS, the controller 150 may decrease a length of the off period in one cycle (or each cycle) of the emission control signal EMS from the initial length (about 10 H in the example of FIG. 6) to a decreased length (about 9 H in the example of FIG. 6).

Further, when the counted time of the current frame reaches the first reference time (S340: YES), the OLED display device 100 may drive the OLED display panel 110 based on the emission control signal EMS having the decreased off period ratio (S360). For example, as illustrated in FIG. 6, after about 6.94 ms from the start of each frame FP1 and FP2, the emission driver 140 may provide the OLED display panel 110 with the emission control signal EMS having the off period decreased from about 10 H to about 9 H in each cycle. As described above, after the time (e.g., about 6.94 ms) of the minimum frame corresponding to the maximum frame rate (e.g., about 144 Hz) of the variable frame mode, the off period ratio of the emission control signal EMS may be decreased, and thus luminance deterioration and an occurrence of a flicker in the variable frame mode may be reduced or prevented.

If a new frame is not started and the current frame continues (S370: NO), the counted time of the current frame may be compared with a second reference time longer than the first reference time (S340), the decreased off period ratio of the emission control signal EMS may be further decreased when the counted time of the current frame reaches the second reference time (S340:YES and S350), and the OLED display panel 110 may be driven based on the emission control signal EMS having the further decreased off period ratio (S360). For example, in the example of FIG. 6, the length of the off period in each cycle of the emission control signal EMS may be decreased from about 10 H to about 9 H after the time (e.g., about 6.94 ms) of the minimum frame from the start of the second frame FP2, and then further after two cycles, the length of the off period in each cycle of the emission control signal EMS may be further decreased from about 9 H to about 8 H. Accordingly, the gradual luminance deterioration caused by the increase of the frame time in the variable frame mode may be more accurately compensated.

In some exemplary embodiments, reference time information RTI for a plurality of reference times including the first and second reference times and off period offset information OPOI for a plurality of off period offsets respectively corresponding to the plurality of reference times may be stored in a memory device 170 of the OLED display device 100. In this case, the counted time of the current frame may be compared with the plurality of reference times based on the reference time information RTI (S340), and, when the counted time of the current frame reaches one reference time of the plurality of reference times (S340: YES), the length of the off period in one cycle (or each cycle) of the emission control signal EMS may be decreased by one off period offset corresponding to the one reference time among the plurality of off period offsets based on the off period offset information OPOI.

If a new frame is started (S370: YES), the OLED display device 100 may drive the OLED display panel 110 again based on the emission control signal EMS having the initial off period ratio (S330).

As described above, in the method of operating the OLED display device 100 supporting the variable frame mode according to exemplary embodiments, the time of the current frame may be counted, and the off period ratio of the emission control signal EMS may be decreased as the counted time of the current frame increases. Accordingly, the luminance deterioration and the occurrence of the flicker caused by the increase of the frame time (or the increase of the time of the variable blank period) in the variable frame mode may be prevented, and the image quality of the OLED display device 100 may be improved.

Figure 7:
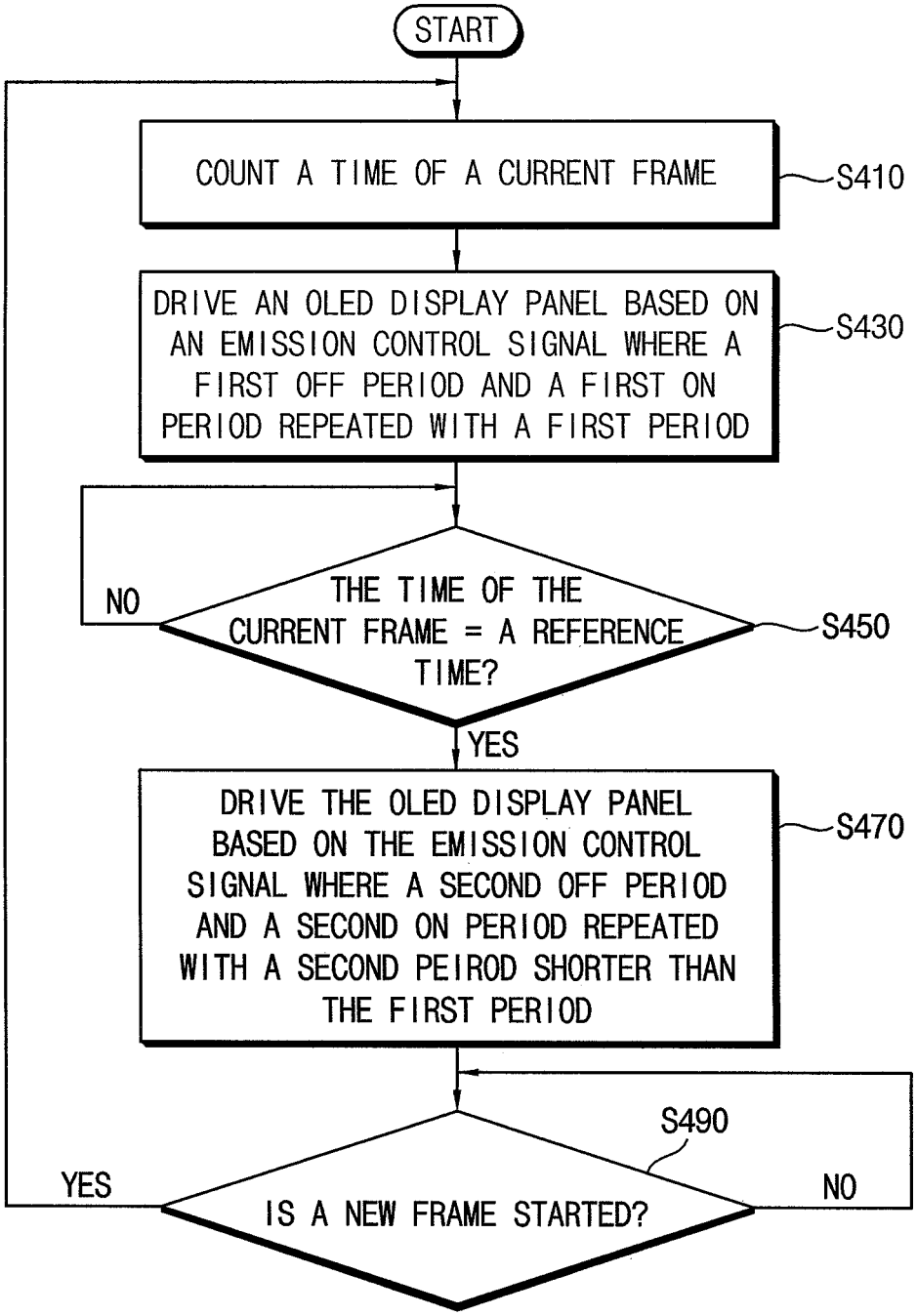
FIG. 7 is a flowchart illustrating a method of operating an OLED display device according to exemplary embodiments.
Figure 8:
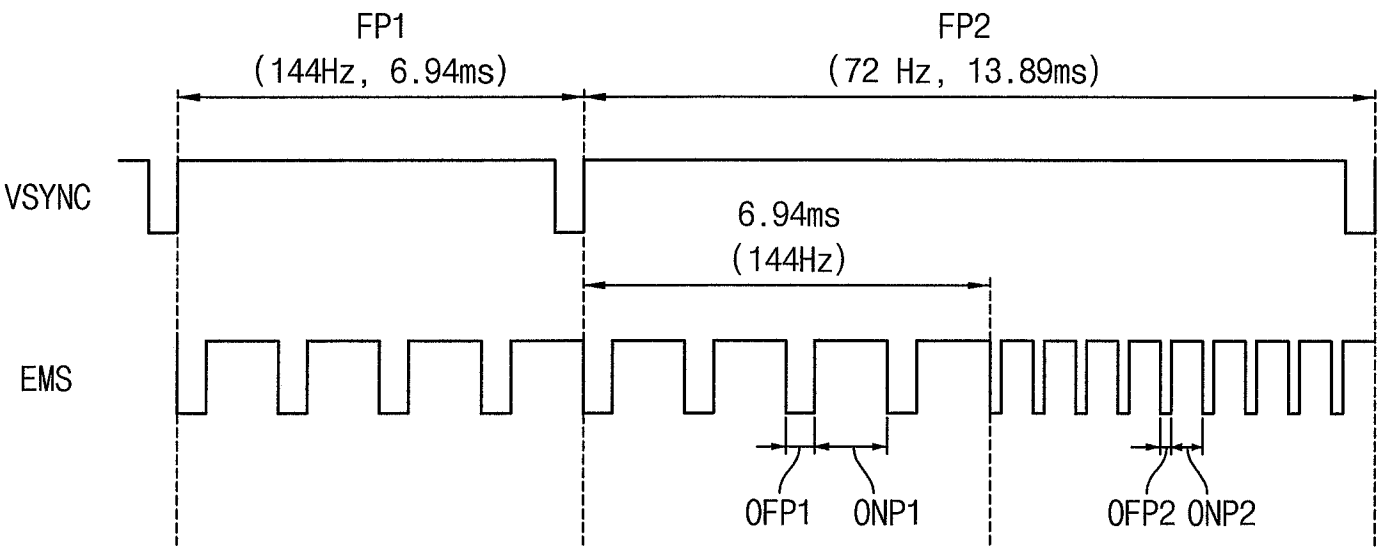
FIG. 8 is a timing diagram for an operation of an OLED display device performing a method of FIG. 7.

FIG. 7 is a flowchart illustrating a method of operating an OLED display device according to exemplary embodiments, and FIG. 8 is a timing diagram for an operation of an OLED display device performing a method of FIG. 7.

Referring to FIG. 1, FIG. 7 and FIG. 8, in a method of operating an OLED display device 100 supporting a variable frame mode, a time of a current frame may be counted (S410), and, until the counted time of the current frame reaches a reference time (S450: NO), the OLED display device 100 may drive an OLED display panel 110 based on an emission control signal EMS where a first off period OFP1 and a first on period ONP1 are repeated with a first period (S430). In some exemplary embodiments, the reference time may correspond to a time (e.g., about 6.94 ms) of the minimum frame corresponding to the maximum frame rate (e.g., about 144 Hz) of the variable frame mode. In some exemplary embodiments, a length (or time) of the first off period OFP1, a length (or time) of the first on period ONP1, and the first period (or a length (or time) of one cycle) may be determined based on a dimming control signal DCS. In an example of FIG. 8, the first period (or the length (or time) of one cycle) may correspond to a quarter of the time (e.g., about 6.94 ms) of the minimum frame.

When the counted time of the current frame reaches the reference time (S450: YES), the OLED display device 100 may drive the OLED display panel 110 based on the emission control signal EMS where a second off period OFP2 and a second on period ONP2 are repeated with a second period shorter than the first period (S470). For example, the second off period OFP2 may have a length of about 2 H, the second on period ONP2 may have a length of about 5 H, and the second period may have a length of about 7 H. However, the lengths may not be limited thereto. In some exemplary embodiments, a ratio of the second off period OFP2 to the second on period ONP2 (or to a sum of the second on period ONP2 and the second off period OFP2) may be substantially the same as a ratio of the first off period OFP1 to the first on period ONP1 (or to a sum of the first on period ONP1 and the first off period OFP1). In other exemplary embodiments, period information PI for the second period may be stored in a memory device 170 included in the OLED display device 100, and a controller 150 may determine the second period based on the period information PI. If a new frame is started (S490: YES), the OLED display device 100 may drive the OLED display panel 110 again based on the emission control signal EMS where the first off period OFP1 and the first on period ONP1 are repeated with the first period (S430).

As described above, after the reference time, or after the time (e.g., about 6.94 ms) of the minimum frame, the emission control signal EMS may have the second off period OFP2 and the second on period ONP2 that are repeated with the relatively short second period, and thus an off period ratio (e.g., the ratio of the second off period OFP2 to the sum of the second on period ONP2 and the second off period OFP2) may not be distorted even if the new frame is started at any time point, thereby improving an image quality in the variable frame mode.

Figure 9:
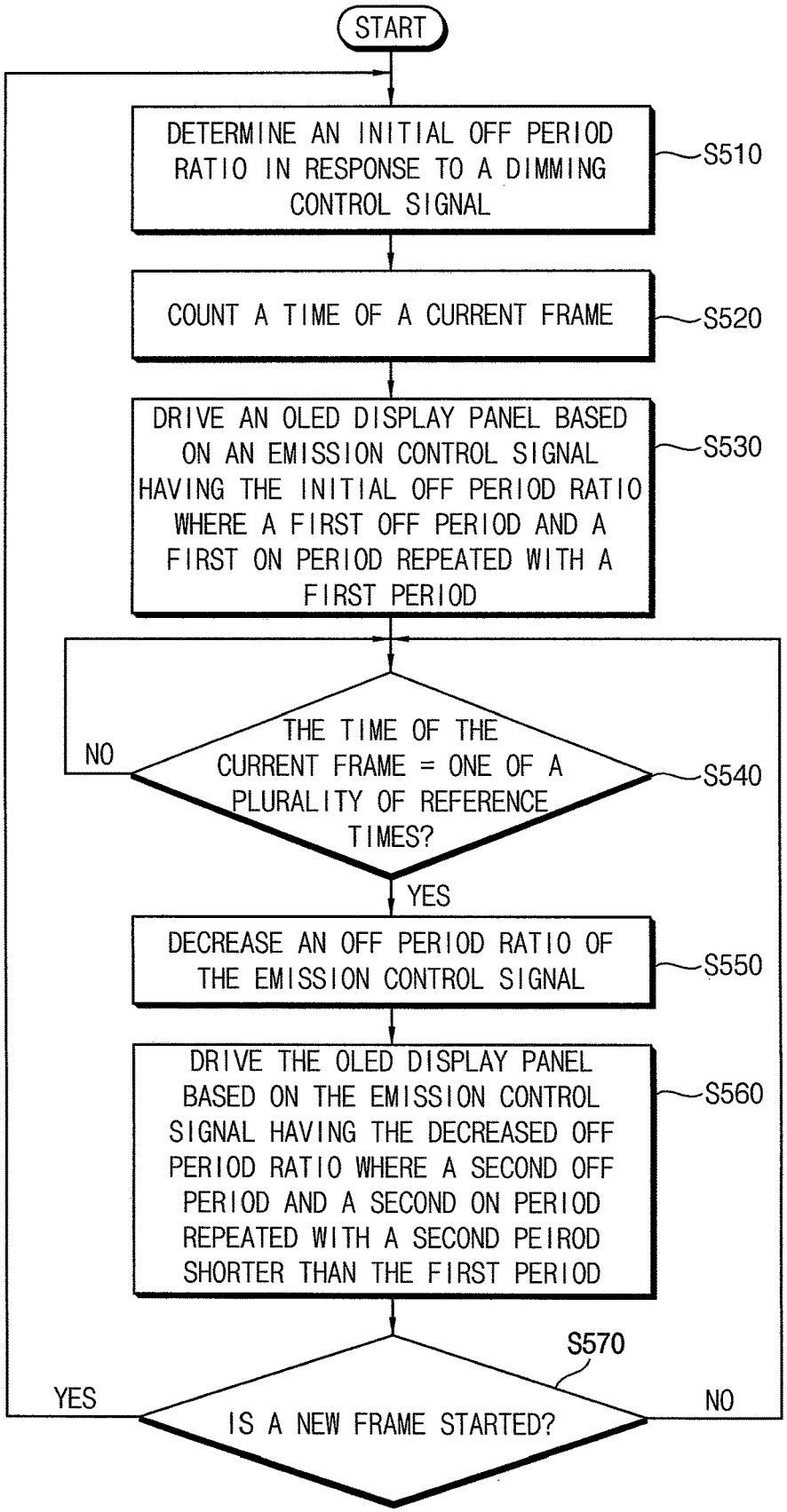
FIG. 9 is a flowchart illustrating a method of operating an OLED display device according to exemplary embodiments.
Figure 10:
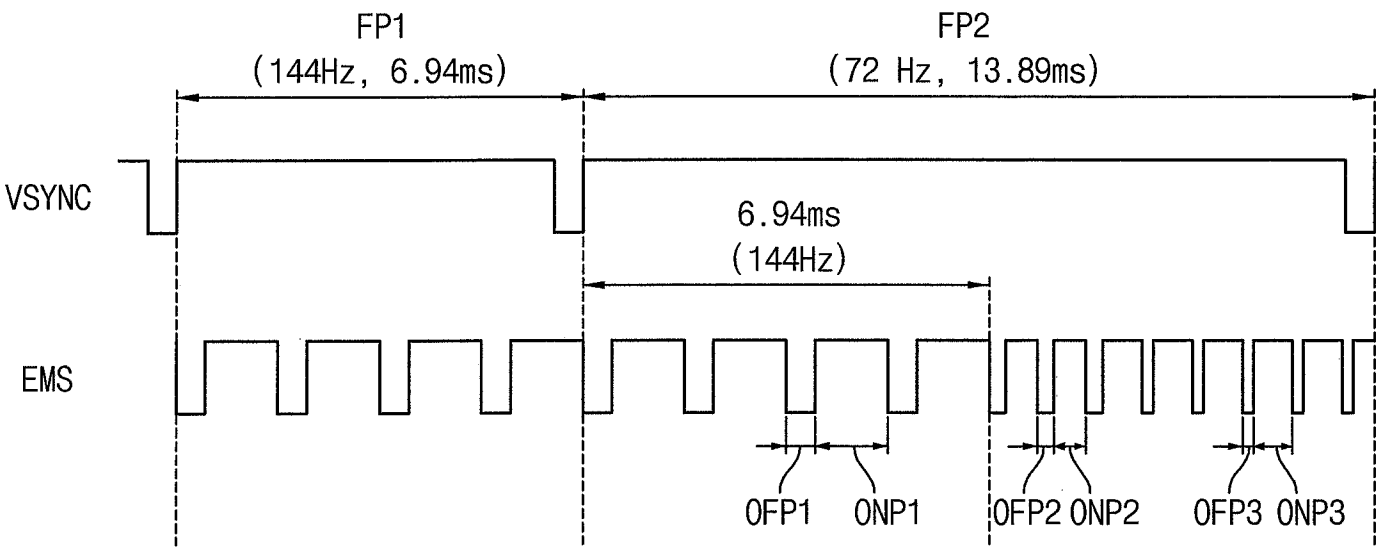
FIG. 10 is a timing diagram for an operation of an OLED display device performing a method of FIG. 9.

FIG. 9 is a flowchart illustrating a method of operating an OLED display device according to exemplary embodiments, and FIG. 10 is a timing diagram for an operation of an OLED display device performing a method of FIG. 9.

Referring to FIG. 1, FIG. 9 and FIG. 10, in a method of operating an OLED display device 100 supporting a variable frame mode, a controller 150 may determine an initial off period ratio of an emission control signal EMS in response to a dimming control signal DCS (S510), and may count a time of a current frame (S520). Until the counted time of the current frame reaches one (e.g., about 6.94 ms) of a plurality of reference times (S540: NO), the OLED display device 100 may drive an OLED display panel 110 based on an emission control signal EMS having the initial off period ratio where a first off period OFP1 and a first on period ONP1 are repeated with a first period (S530). In an example of FIG. 10, the first period (or the length (or time) of one cycle) of the first off period OFP1 and the first on period ONP1 may correspond to a quarter of the time (e.g., about 6.94 ms) of the minimum frame, and the initial off period ratio (or a ratio of the first off period OFP1 to a sum of the first on period ONP1 and the first off period OFP1) may correspond to about 10 H divided by the quarter of the time of the minimum frame When the counted time of the current frame reaches one of the plurality of reference times (S450: NO), the OLED display device 100 may drive the OLED display panel 110 based on the emission control signal EMS having an off period ratio decreased from the initial off period ratio where a second off period OFP2 and a second on period ONP2 are repeated with a second period shorter than the first period (S560). Since the emission control signal EMS has the second off period OFP2 and the second on period ONP2 that are repeated with the relatively short second period, even if a new frame is started at any time point (S570: YES), the off period ratio (e.g., the ratio of the second off period OFP2 to the sum of the second on period ONP2 and the second off period OFP2) may not be distorted. Further, since the off period ratio of the emission control signal EMS is decreased from the initial off period ratio, or since a ratio of the second off period OFP2 to the second on period ONP2 (or to a sum of the second on period ONP2 and the second off period OFP2) may be decreased compared with a ratio of the first off period OFP1 to the first on period ONP1 (or to a sum of the first on period ONP1 and the first off period OFP1), luminance deterioration and an occurrence of a flicker caused by an increase of a frame time in the variable frame mode may be reduced or prevented.

In some exemplary embodiments, reference time information RTI for a plurality of reference times, off period offset information OPOI for a plurality of off period offsets respectively corresponding to the plurality of reference times, and period information PI for the second period may be stored in a memory device 170 of the OLED display device 100. In this case, the controller 150 may compare the counted time of the current frame with the plurality of reference times based on the reference time information RTI (S540), and, when the counted time of the current frame reaches one of the plurality of reference times (S540: YES), the length of the second off period OFP2 and the length of the second on period ONP2 may be determined based on the period information PI and the off period offset information OPOI.

If a new frame is not started and the current frame continues (S570: NO), the counted time of the current frame may be compared with the plurality of reference times (S540), and, when the counted time of the current frame reaches the next one of the plurality of reference times (S540: YES), the decreased off period ratio of the emission control signal EMS may be further decreased (S550). For example, an off period of the emission control signal EMS may be decreased from the second off period OFP2 to a third off period OFP3, and an on period of the emission control signal EMS may be increased from the second on period ONP2 to a third on period ONP3. That is, a ratio of the third off period OFP3 to a sum of the third on period ONP3 and the third off period OFP3 may be further decreased compared with the ratio of the second off period OFP2 to the sum of the second on period ONP2 and the second off period OFP2. Accordingly, the luminance deterioration caused by the increase of the frame time in the variable frame mode may be more accurately compensated. In some exemplary embodiments, a third period with which the third off period OFP3 and the third on period ONP3 are repeated may be substantially the same as the second period with which the second off period OFP2 and the second on period ONP2, but the second and third periods may not be limited thereto.

If a new frame is started (S570: YES), the OLED display device 100 may drive the OLED display panel 110 again based on the emission control signal EMS having the initial off period ratio where the first off period OFP1 and the first on period ONP1 are repeated with the first period (S530).

Figure 11:
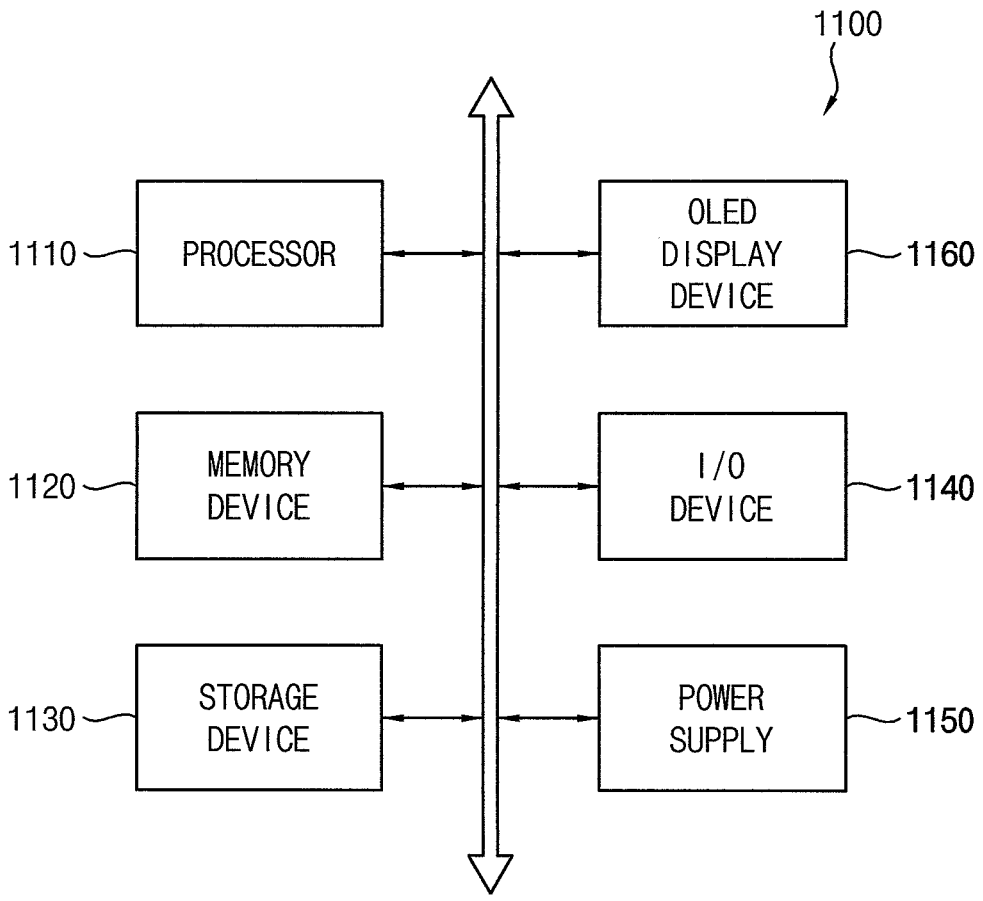
FIG. 11 is a block diagram illustrating an electronic device including an OLED display device according to exemplary embodiments.

FIG. 11 is a block diagram illustrating an electronic device including an OLED display device according to exemplary embodiments.

Referring to FIG. 11, an electronic device 1100 may include a processor 1110, a memory device 1120, a storage device 1130, an input/output (I/O) device 1140, a power supply 1150, and an OLED display device 1160. The electronic device 1100 may further include a plurality of ports for communicating a video card, a sound card, a memory card, a universal serial bus (USB) device, other electric devices, etc.

The processor 1110 may perform various computing functions or tasks. The processor 1110 may be an application processor (AP), a micro processor, a central processing unit (CPU), etc. The processor 1110 may be coupled to other components via an address bus, a control bus, a data bus, etc. Further, in some exemplary embodiments, the processor 1110 may be further coupled to an extended bus such as a peripheral component interconnection (PCI) bus.

The memory device 1120 may store data for operations of the electronic device 1100. For example, the memory device 1120 may include at least one non-volatile memory device such as an erasable programmable read-only memory (EPROM) device, an electrically erasable programmable read-only memory (EEPROM) device, a flash memory device, a phase change random access memory (PRAM) device, a resistance random access memory (RRAM) device, a nano floating gate memory (NFGM) device, a polymer random access memory (PoRAIVI) device, a magnetic random access memory (MRAM) device, a ferroelectric random access memory (FRAM) device, etc, and/or at least one volatile memory device such as a dynamic random access memory (DRAM) device, a static random access memory (SRAM) device, a mobile dynamic random access memory (mobile DRAM) device, etc.

The storage device 1130 may be a solid state drive (SSD) device, a hard disk drive (HDD) device, a CD-ROM device, etc. The I/O device 1140 may be an input device such as a keyboard, a keypad, a mouse, a touch screen, etc, and an output device such as a printer, a speaker, etc. The power supply 1150 may supply power for operations of the electronic device 1100. The display device 1160 may be coupled to other components through the buses or other communication links.

In some exemplary embodiments, the OLED display device 1160 may count a time of a current frame, and may decrease an off period ratio of an emission control signal as the counted time of the current frame increases, thereby preventing luminance deterioration and an occurrence of a flicker caused by an increase of a time of a variable blank period in a variable frame mode and improving an image quality of the OLED display device 1160. In other exemplary embodiments, the OLED display device 1160 may decrease a period of the emission control signal when the counted time of the current frame reaches a reference time, thereby improving the image quality of the OLED display device 1160.

The inventive concepts may be applied to any OLED display device 1160 supporting the variable frame mode, and any electronic device 1100 including the OLED display device 1160. For example, the inventive concepts may be applied to a smart phone, a wearable electronic device, a tablet computer, a mobile phone, a television (TV), a digital TV, a 3D TV, a personal computer (PC), a home appliance, a laptop computer, a personal digital assistant (PDA), a portable multimedia player (PMP), a digital camera, a music player, a portable game console, a navigation device, etc.

As described above, the OLED display device and the method of operating the OLED display device according to exemplary embodiments may count a time of a current frame, and may decrease an off period ratio of an emission control signal as the counted time of the current frame increases, thereby preventing deterioration of luminance and occurrence of a flicker caused by an increase of a time of a variable blank period in a variable frame mode. Accordingly, an image quality of the OLED display device may be improved.

Although certain exemplary embodiments and implementations have been described herein, other embodiments and modifications will be apparent from this description. Accordingly, the inventive concepts are not limited to such embodiments, but rather to the broader scope of the appended claims and various obvious modifications and equivalent arrangements as would be apparent to a person of ordinary skill in the art.

What is claimed is:

1. An organic light emitting diode (OLED) display device supporting a variable frame mode, the OLED display device comprising:

an OLED display panel;

a data driver configured to provide a data signal to the OLED display panel;

a scan driver configured to provide a scan signal to the OLED display panel;

an emission driver configured to provide an emission control signal to the OLED display panel; and a controller configured to control the data driver, the scan driver, and the emission driver, to count a time of a current frame, and to control the emission driver to decrease an off period ratio of the emission control signal as the counted time of the current frame increases, wherein the controller is configured to:

determine an initial off period ratio of the emission control signal in response to a dimming control signal;

control the emission driver to output the emission control signal having the initial off period ratio until the counted time of the current frame reaches a time of a minimum frame corresponding to a maximum frame rate of the variable frame mode; and control the emission driver to output the emission control signal having the off period ratio that is decreased from the initial off period ratio when the counted time of the current frame reaches the time of the minimum frame.

2. The OLED display device of claim 1, wherein the controller is configured to control the emission driver to gradually or stepwise decrease the off period ratio of the emission control signal as the counted time of the current frame increases to compensate for luminance of the OLED display panel which is decreased as the counted time of the current frame increases.

3. The OLED display device of claim 1, wherein the controller is configured to:

determine a length of a whole off period of the emission control signal in the minimum frame in response to the dimming control signal;

determine a number of cycles of the emission control signal and an initial length of an off period in one cycle of the emission control signal during the minimum frame based on the determined length of the whole off period; and decrease a length of the off period in one cycle of the emission control signal from the initial length when the counted time of the current frame reaches the time of the minimum frame.

4. The OLED display device of claim 1, further comprising:

a memory device configured to store reference time information for a plurality of reference times that are to be compared with the counted time of the current frame, and off period offset information for a plurality of off period offsets respectively corresponding to the plurality of reference times.

5. The OLED display device of claim 4, wherein the controller is configured to:

compare the counted time of the current frame with the plurality of reference times based on the reference time information; and when the counted time of the current frame reaches one reference time of the plurality of reference times, decrease a length of an off period in one cycle of the emission control signal by one off period offset corresponding to the one reference time among the plurality of off period offsets based on the off period offset information.

6. The OLED display device of claim 1, wherein the controller is configured to:

control the emission driver to output the emission control signal where a first off period and a first on period are repeated with a first period until the counted time of the current frame reaches the time of the minimum frame corresponding to the maximum frame rate of the variable frame mode; and control the emission driver to output the emission control signal where a second off period and a second on period are repeated with a second period shorter than the first period when the counted time of the current frame reaches the time of the minimum frame.

7. The OLED display device of claim 6, wherein a ratio of the second off period to the second on period is decreased compared with a ratio of the first off period to the first on period.

8. A method of operating an organic light emitting diode (OLED) display device supporting a variable frame mode, the method comprising:

determining an initial off period ratio of an emission control signal in response to a dimming control signal;

counting a time of a current frame;

driving an OLED display panel of the OLED display device based on the emission control signal having the initial off period ratio until the counted time of the current frame reaches a first reference time;

decreasing an off period ratio of the emission control signal from the initial off period ratio when the counted time of the current frame reaches the first reference time; and driving the OLED display panel based on the emission control signal having the decreased off period ratio when the counted time of the current frame reaches the first reference time.

9. The method of claim 8, wherein determining the initial off period ratio of the emission control signal in response to the dimming control signal includes:

determining a length of a whole off period of the emission control signal in a minimum frame corresponding to a maximum frame rate of the variable frame mode in response to the dimming control signal; and determining a number of cycles of the emission control signal and an initial length of an off period in one cycle of the emission control signal during the minimum frame based on the determined length of the whole off period.

10. The method of claim 9, wherein decreasing the off period ratio of the emission control signal from the initial off period ratio includes:

decreasing a length of the off period in one cycle of the emission control signal from the initial length.

11. The method of claim 8, wherein the first reference time corresponds to a time of a minimum frame corresponding to a maximum frame rate of the variable frame mode.

12. The method of claim 8, further comprising:

comparing the counted time of the current frame with a second reference time longer than the first reference time; and further decreasing the decreased off period ratio of the emission control signal when the counted time of the current frame reaches the second reference time.

13. The method of claim 8, further comprising:

storing reference time information for a plurality of reference times including the first reference time, and off period offset information for a plurality of off period offsets respectively corresponding to the plurality of reference times;

comparing the counted time of the current frame with the plurality of reference times based on the reference time information; and when the counted time of the current frame reaches one reference time of the plurality of reference times, decreasing a length of an off period in one cycle of the emission control signal by one off period offset corresponding to the one reference time among the plurality of off period offsets based on the off period offset information.

14. A method of operating an organic light emitting diode (OLED) display device supporting a variable frame mode, the method comprising:

counting a time of a current frame;

driving an OLED display panel of the OLED display device based on an emission control signal where a first off period and a first on period are repeated with a first period until the counted time of the current frame reaches a first reference time; and driving the OLED display panel of the OLED display device based on the emission control signal where a second off period and a second on period are repeated with a second period shorter than the first period when the counted time of the current frame reaches the first reference time.

15. The method of claim 14, wherein the first reference time corresponds to a time of a minimum frame corresponding to a maximum frame rate of the variable frame mode.

16. The method of claim 14, wherein a ratio of the second off period to the second on period is a same as a ratio of the first off period to the first on period.

17. The method of claim 14, wherein period information for the second period is stored in a memory device included in the OLED display device.

18. The method of claim 14, wherein a ratio of the second off period to the second on period is decreased compared with a ratio of the first off period to the first on period.

19. The method of claim 14, further comprising:

storing reference time information for a plurality of reference times including the first reference time, and off period offset information for a plurality of off period offsets respectively corresponding to the plurality of reference times;

comparing the counted time of the current frame with the plurality of reference times based on the reference time information; and when the counted time of the current frame reaches one reference time of the plurality of reference times, decreasing a length of the second off period in one cycle of the emission control signal by one off period offset corresponding to the one reference time among the plurality of off period offsets based on the off period offset information.

* * * * *